US007163909B2

(12) United States Patent
Ukpabi

(10) Patent No.: US 7,163,909 B2
(45) Date of Patent: Jan. 16, 2007

(54) AUTHENTICITY INDICATOR

(75) Inventor: Pauline Ozoemena Ukpabi, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 278 days.

(21) Appl. No.: 10/831,525

(22) Filed: Apr. 23, 2004

(65) Prior Publication Data

US 2005/0239649 A1 Oct. 27, 2005

(51) Int. Cl.
*B41M 5/20* (2006.01)

(52) U.S. Cl. ..... 503/201; 283/94; 283/95; 503/216

(58) Field of Classification Search ..... 283/1–117; 500/200–226

See application file for complete search history.

(56) References Cited

U.S. PATENT DOCUMENTS

| | | | | |
|---|---|---|---|---|
| 3,363,336 A | | 1/1968 | Skinner | 35/36 |
| 3,957,495 A | | 5/1976 | Teranishi et al. | 106/19 |
| 4,037,007 A | | 7/1977 | Wood | 428/199 |
| 4,171,982 A | | 10/1979 | Lin | 106/21 |
| 4,272,106 A | | 6/1981 | Auger | 282/27.5 |
| 4,496,961 A | | 1/1985 | Devrient | 346/206 |
| 4,680,598 A | * | 7/1987 | Obitsu et al. | 503/217 |
| 4,687,862 A | * | 8/1987 | Obitsu et al. | 549/224 |
| 4,865,648 A | | 9/1989 | Kito et al. | 106/21 |
| 5,063,163 A | | 11/1991 | Carmeli | 436/94 |
| 5,130,290 A | | 7/1992 | Tanimoto | 503/201 |
| 5,139,572 A | | 8/1992 | Kawashima | 106/21 |
| 5,196,243 A | | 3/1993 | Kawashima | 428/29 |
| 5,209,515 A | | 5/1993 | Dotson et al. | 283/95 |
| 5,215,956 A | | 6/1993 | Kawashima | 503/201 |
| 5,250,492 A | | 10/1993 | Dotson et al. | 503/201 |
| 5,286,061 A | | 2/1994 | Behm | 283/95 |
| 5,290,068 A | | 3/1994 | Gundjian | 283/67 |
| 5,395,138 A | | 3/1995 | Chang | 283/95 |
| 5,427,415 A | | 6/1995 | Chang | 283/67 |
| 5,460,647 A | | 10/1995 | Snedeker et al. | 106/22 A |
| 5,485,792 A | | 1/1996 | Keyser et al. | 106/21 R |
| 5,486,228 A | | 1/1996 | Miller et al. | 106/22 B |
| 5,595,590 A | | 1/1997 | Belding et al. | 106/21 A |
| 5,595,955 A | | 1/1997 | Chang et al. | 503/201 |
| 5,605,873 A | | 2/1997 | Chang | 503/201 |
| 5,698,296 A | | 12/1997 | Dotson et al. | 428/195 |
| 5,786,509 A | | 7/1998 | Belding et al. | 564/223 |
| 6,114,281 A | | 9/2000 | Belding et al. | 503/201 |
| 6,203,603 B1 | | 3/2001 | Takayama et al. | 106/31.16 |
| 6,783,991 B1 | | 8/2004 | Mehta et al. | 436/164 |
| 2003/0089270 A1 | | 5/2003 | Shen et al. | |

FOREIGN PATENT DOCUMENTS

EP 0530059 A1 3/1993

OTHER PUBLICATIONS

Forty Centuries of Ink by David N. Carvalho, First Edition, New York, The Banks Law Publishing Co., Copyright 1904.
An Ancient Art and Modern Sport by Charles de Beaumont, ES Barnes, 1978.

* cited by examiner

*Primary Examiner*—Bruce H. Hess
(74) *Attorney, Agent, or Firm*—Benjamin Mieliulis

(57) ABSTRACT

A rapidly reversing authenticity indicator for substrates such as secure documents, tags and labels is described. The authenticity indicator comprises a substrate having provided thereon a coating of a colorless chromogenic material, a binder material and optional pigment. An applicator is provided containing a developer material solution for the colorless chromogen. In one embodiment, the developer material solution is preferably an organic acid of five carbons or less and is selected to have a molecular weight of 102 or less, a pH of less than 5, and preferably positive vapor pressure. The coated substrate when contacted with the developer material in the applicator develops an intense color that persists momentarily rapidly reverting to substantially a colorless or pale form to provide a visual indication of authenticity without permanent discoloration of the substrate or inadvertent coloration or undue false positives.

17 Claims, No Drawings

AUTHENTICITY INDICATOR

BACKGROUND OF THE INVENTION

1. Field of the Invention

This invention relates to methods and indicators of authenticity. The invention is particularly useful with documents, tags, and labels.

2. Description of the Related Art

Indicators to ascertain the genuineness of documents, tags and labels have been proposed in several different forms.

U.S. Pat. No. 3,063,163 to Carmeli teaches a method of detecting counterfeit currency substrates by applying an iodine solution to the substrate to react with starch yielding a brown to black marking. Carmeli is a negative indicator in that genuine currency does not undergo a color change. Counterfeit currency on the other hand forms a bluish black mark with the iodine indicator, attributed to a difference in starch content. The marking is fairly permanent, however can be made to dissipate over a few days by inclusion of oxidizing agent.

Wood U.S. Pat. No. 4,037,007 teaches secure documents with color forming planchettes. A color forming reaction of azo compounds or lactone or leuco compounds with an organic acid is taught for forming a color change or change from colorless to colored form. Over time or repeated use, such planchettes are undesirable as unsightly producing color changed or discolored areas of relative permanence.

U.S. Pat. No. 5,130,290 to Tanimoto teaches a reversible coloring sheet based on coating a basic dye and color developer onto a sheet together with a desensitizer such as polyethylene glycol. The resulting coated substrate develops a color upon contact with water which can reverse upon removal of the water. Although functional with only application of water, this system would have the drawback of unsolicited color change due to inadvertent wetting, rain, high humidity and other events attributable to the ubiquitous presence of water in many areas of application or conditions of use.

EP 0 530 059 discloses a system based on a complex formed by potassium thiocyanate with transition metals such as iron or copper. After color formation, a second material, a reducing agent such as sodium sulfite or bisulfite is applied to obliterate the color formed.

To date, no authentication system based on a color change upon contact with an applicator material has been described or suggested, which comprises a momentarily visible color change that reverts to a colorless form upon removal of the applicator, and which is resistant to unintended coloration due to inadvertent wetting.

Such an invention would be commercially useful providing a system that is not prone to image inadvertently and solves the problem of unsightly discoloration of the tested surface of the substrate.

It is an object of the present invention to disclose a rapidly reversing authenticity indicator. It is a further object of the invention to disclose a positive indicator.

It is a further object of the present invention to disclose a combination of colorless or lightly chromogenic materials in combination with a selected set of developers that yield momentary indicators.

It is a further object of the invention to disclose reversible authenticity indicators that can be employed with a substrate without permanent marking or unsightly discoloration.

It is a further object of the invention to disclose a rapidly reversing authenticity indicator that can be employed with a substrate to preclude inadvertent discoloration and to minimize false positives.

SUMMARY OF THE INVENTION

A rapidly reversing authenticity indicator for substrates such as secure documents, tags and labels is described. The authenticity indicator comprises a substrate having provided thereon a coating of a colorless chromogenic material and a binder material. An applicator is provided having a developer material solution for the colorless chromogen. The developer material solution is selected to have a molecular weight of 102 or less, a pH of 3.5 or less, and a positive vapor pressure.

The invention teaches a rapidly reversing authenticity indicator for a substrate comprising a substrate having provided thereon a coating comprising a substantially colorless chromogenic material and a binder material. (Optionally the substrate coating includes a pigment. This can be useful if the chromogen selected is pale colored rather than colorless.) An applicator is provided containing a developer material, the developer material comprising an organic acid of five carbons or less, a molecular weight of 102 or less, and a pH of 3.5 or less. The coated substrate when contacted with the developer material develops an intense color that fades to provide a visual indication of authenticity of the substrate. In a preferred embodiment, the substrate is selected from paper or plastic film.

In one embodiment, the developer material is selected from formic acid, acetic acid, propionic acid, butyric acid, isobutyric acid and pentanoic acid. In yet another embodiment, the developer material is a solvent solution of oxalic acid at a concentration by weight of 3% or less. Preferably the developer material or solvent solution of developer material has a positive vapor pressure. Optionally the substrate coating includes a pigment of color similar to the chromogenic material. More preferably the developer material has a pH of less than 2.2.

In yet another embodiment, the rapidly reversing authenticity indicator for a substrate comprises a substrate having provided thereon a coating comprising a substantially colorless chromogenic material and a binder material. An applicator containing a developer material is provided. The developer material comprises a dilute mineral acid having a molecular weight of less than about 102, and a pH of less than 3.5. The coated substrate when contacted with the developer material develops an intense color that fades to provide a visual indication of authenticity of the substrate. Preferably, the mineral acid is at a concentration of 20% or less by weight. The mineral acid can be dispersed in appropriate solvent.

The invention teaches a rapidly reversing authenticity indicator for a substrate comprising a substrate having provided thereon a coating comprising a substantially colorless chromogenic material and a binder material; an applicator containing a developer material, the developer material comprising an organic acid of five carbons or less, a molecular weight of 102 or less, and a pH of 3.5 or less wherein the coated substrate when contacted with the developer material develops an intense color that fades to provide a visual indication of authenticity of the substrate.

In a preferred embodiment, the substrate is selected from paper or plastic film. The developer material is a liquid acidic material or an acidic material and solvent. Dissolving the acidic material in a solvent or a blend of solvents can be advantageous. The developer material is a liquid acidic material or an acidic material dissolved or dispersed in a solvent.

In one embodiment, the developer material is selected from formic acid, acetic acid, propionic acid, butyric acid, isobutyric acid and pentanoic acid. In yet another embodiment the developer material is a solvent solution of oxalic acid at a concentration by weight of 3% or less. Preferably the developer material or developer and solvent solution has a positive vapor pressure, and optionally the substrate coating includes a pigment of color similar to the chromogenic material. More preferably the developer material has a pH of less than 2.2.

In yet another embodiment, the rapidly reversing authenticity indicator for a substrate comprises a substrate having provided thereon a coating comprising a substantially colorless chromogenic material and a binder material. An applicator containing a developer material is provided. The developer material comprises a dilute mineral acid having a molecular weight of less than about 102, and a pH of less than 3.5. The coated substrate when contacted with the developer material develops an intense color that fades to provide a visual indication of authenticity of the substrate. Preferably, the mineral acid is at a concentration of 20% or less and more preferably 10% or less by weight.

DETAILED DESCRIPTION

A momentary authenticity indicator for substrates such as secure documents, tags and labels is described. The authenticity indicator comprises a substrate having provided thereon a coating of a lightly colored, and preferably colorless chromogenic material and a binder material. An applicator is provided having a developer material solution for the colorless chromogen. The developer material solution is selected to have a molecular weight of less than about 102, a pH of less than 3.5 and a positive vapor pressure, preferably a vapor pressure in excess of 0.001 kPa at 25° C. In certain embodiments a pH of less than 2.2 is desirable. The applicator can take the form of a felt pen, sponge applicator, marker, roller, fluid dispenser, fountain pen, gel pen, cotton swab, and the like.

The authenticity indicator of the invention is momentary, meaning that it is rapidly reversing. The coated substrate when contacted with the developer material in the applicator develops an intense color that fades in a few minutes, preferably seconds, to be substantially colorless. In a preferred embodiment the reversal from the colored form to the colorless form takes three minutes or less, and more preferably a positive vapor pressure of the solvent or developer augments the rapid reversibility of the color of the chromogenic material.

The positive vapor pressure is the vapor pressure of the developer material solution where the developer material solution is an acidic developer material and solvent, the vapor pressure can be largely the vapor pressure of the solvent.

The chromogenic materials useful in the invention are colorless or lightly colored electron donating dye precursors. These chromogenic materials or electron donating dye precursors are also commonly referred to as colorformers. These colorformers include without limitation phthalide, leucauramine and fluoran compounds. Chromogenic materials include Crystal Violet Lactone (3,3-bis(4-dimethylaminophenyl)-6-dimethylaminophthalide, U.S. Pat. No. RE. 23,024); phenyl-, indol-, pyrrol- and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spiro-dipyrans (U.S. Pat. No. 3,971,808); and pyridine and pyrazine compounds (for example, in U.S. Pat. Nos. 3,775,424 and 3,853,869). Other eligible chromogenic materials include: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3-5'6-tris(di-methylamino)spiro[9H-fluorene-9'1(3'H)-isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino) fluoran (U.S. Pat. No. 3,920,510); 3-(N-methylcyclohexylamino)-6-methyl-7-anilino-fluoran (U.S. Pat. No. 3,959,571); 7-(1-octyl-2-methylindol-3-yl)-7-4-(4-diethylamino-2-ethoxy-phenyl)-5,7-dihydrofuro [3,4-b] pyridin-5-one; 3-diethylamino-7,8-benzofluoran; 3,3-bis(1-ethyl-2-methylindol-3-yl) phthalide; 3-diethylamino-7-anilino-fluoran; 3-diethylamino-7-benzylamino-fluoran; 3'-phenyl-7-dibenzylamino-2,2'-spiro-di-[2H-1-benzo-pyran]; 6'[ethyl(3-methylbutyl)amino]-3'-methyl-2' (phenylamino)-spiro[isobenzofuran-1(3H), 9'-[9H]xanthen]-3-one; 6-(dimethylamino-3,3-bis(4-(dimethylamino)phenyl)-1 (3H)-isobenzofuranone (crystal violet lactone); 3-diethylamino-6-methyl-7-(2,4-dimethylphenyl)aminofluoran and the like and mixtures of any of the foregoing. The above identified patents are incorporated herein by reference as if fully set forth herein.

The chromogenic material is prepared into a coating composition by dispersing the chromogenic material in water as a dispersing medium or optionally by dispersing or emulsifying the chromogenic material in a suitable solvent, such as water, lower alcohols, alkyl ketones or blends of any of the foregoing. Illustrative solvents can include water, methanol, ethanol, propanol, isopropanol, acetone, methyl ethyl ketone and the like. Water was the most convenient to use. The chromogenic material was slurried in water and dispersant.

In certain examples herein, the slurry is approximately 88.8% by weight dye, 10% polyvinyl alcohol, 1.2% of a nonyl phenol dispersed in water. The coating on the substrate contains about 5% of this dye slurry blended with from 10% to 75% of an aqueous solution of calcium carbonate, 25% to 55% clay and 10 to 30% styrene acrylate binder.

The coating composition may include other suitable binders such as polyvinylalcohol, polyvinylacetate, starch, styrene-maleic anhydride copolymer, carboxylated polyvinylalcohol, polyvinylbutyrol, ethyl cellulose, hydroxypropyl cellulose, latex such as polyacrylate, styrene butadiene, rubber latex and polystyrene.

Other optional ingredients can include defoamers, rheology modifiers, surfactants, dispersion aids and the like. The coating can include inert pigments such as clay, talc, calcium carbonate, silica, waxes, synthetic waxes, lubricants such as zinc stearate or calcium stearate and the like.

The ranges for the components of the coating composition as used in the present invention are from about 5 to 95 wt % pigment, and more preferably from about 60 to 90 wt % pigment; from about 0.05 to about 30 wt % chromogenic material and more preferably from about 0.1 to 10 wt % chromogenic material; from about 2 to 60 wt % binder, and more preferably from about 5 to 30 wt % binder.

The substrate can be paper or film. It can be opaque, transparent or translucent, and could, itself, be colored or not. Preferably the substrate is a fibrous material such as paper or filamentous synthetic material. It can be a film including for example, cellophane and synthetic polymeric sheets, cast, extruded or otherwise formed, and can include cast, air-laid, woven and nonwoven substrates. The substrate typically would have two large surface dimensions and a comparatively small thickness dimension. The substrate can include sheets, webs, ribbons, tapes, cards, tags, belts, films, labels and the like. Typical substrates are those used for important documents, such as negotiable instruments, bonds, passports, receipts, bills of sale, visas, notary acknowledgements, customs documents, papers, tickets, boarding passes, contracts, licenses, deeds, tags, and labels.

The developer material is used neat or dissolved or dispersed in a suitable solvent or diluent such as water, a lower alcohol, alkyl ketone and the like. Isopropanol, and water and alcohol solutions were convenient diluents. The developer material is preferably made into a liquid solution. The preferred ranges for the components of the developer material are from 0.5 wt % to about 100 wt % acidic developer; and, from 0 wt % to about 99.5 wt % solvent.

Other optional ingredients such as rheology modifiers, lubricants, and surfactants can also be included.

The developer material is positioned in an applicator, which can take the form of a felt pen, roller, swab applicator, stylus, felt tip marker, or other suitable dispenser to deliver the developer solution to the substrate.

The developer material is selected to form a fleeting coloration of the chromogenic material. By appropriate selection of the developer material according to the invention, the chromogenic material, when contacted with the applicator containing the developer material, briefly causes the chromogenic material coated on the substrate to change to an intense coloration that rapidly reverts to a colorless form upon removal of the applicator.

With some colored substrates, it may be possible to employ lightly colored chromogens effectively. It is preferable to employ colorless chromogens as these optimize overall security benefits making the presence of the system more covert.

With use of the composition according to the invention, the intense coloration of the composition is seen to persist briefly for a few minutes, preferably seconds. Preferably the intense coloration is visible for three minutes or less, or more preferably on the order of 10 to 90 seconds. Solvent choice can also influence the reversion rate. More volatile solvents tend to also accelerate the rate of disappearance of coloration.

The developer material is typically an organic acid selected to be of low molecular weight, preferably having a molecular weight of about 102 or less, five carbons or less and a positive vapor pressure, preferably in excess of 0.00001 kPa at 25° C.

The coated substrate, when contacted with the developer material in the applicator immediately develops an intense color that fades upon removal of the applicator. This provides a convenient visual indication of the authenticity of the coated substrate.

The coating composition with chromogenic material can be applied to the substrate by means of conventional techniques such as air knife, blade, rod, flexo coater, curtain coater and the like. The coating can be applied in one or more layers as desired. Coat weights typically would be from about 1 to 9 grams per square meter, and more preferably about 2 to 6 grams per square meter. Most preferably, the coating is applied at about 3 grams per square meter.

Developer materials useful for forming a rapidly reverting color formation with the chromogenic material include: organic acids such as formic acid, acetic acid, propionic acid, butyric acid, isobutyric acid and pentanoic acid.

It was observed generally that organic acids having 5 carbons or less were effective.

Organic acid color developers not meeting the criteria of 5 carbons or less, a molecular weight of about 102 or less, a pH of 3.5 or less, and a positive vapor pressure (in excess of 0.00001 kPa at 25° C.) consistently yielded colorations that were not reversible, meaning they persisted for extended time periods and in most cases were permanent colors.

Mineral acids in the appropriate molecular weight range, if appropriately diluted to about 20% or less by weight were also functional. At higher concentrations, these acids however yielded non-reversible colors. With mineral acids, a pH about 3.5 or less, was especially advantageous. Useful mineral acids include dilute hydrochloric acid phosphorous acid and sulfuric acid.

The following examples are given to illustrate some of the features of the present invention and should not be considered as limiting. Unless otherwise indicated, all measurements, parts and proportions herein are in the metric system and on the basis of weight.

EXAMPLES

Table 1 illustrates coatings for substrates. These coatings were applied onto a paper substrate using either airknife or blade applicators at about 5 grams/square meter. The chromogen (dye slurry) in the examples was 3,3-bis[4-(dimethylamino)phenyl]-6-(dimethylamino)-1-(3H isobenzofuranone (blue). Other chromogens were also similarly prepared into coatings to demonstrate preparation of coated substrates and tested for reversibility. Similar results were obtained. These included 2'-dibenzylamino-6'-diethylamino fluoran (green), 2'-anilino-6'diethylamino-3'-methyl fluoran (black), and 3,3-bis[1-(butyl)-2-(methyl)indolinyl]-1-(3-H-isobenzofuran-3-one (magenta). Surface pH's of dried coated substrates were measured in the range of 7.5 to 8.6.

In Table 3, the noted developers were prepared as solutions in water or in isopropanol (70%)/water (30%) at concentrations ranging from 0.5% to 90%. The developers were tested by application with a cotton swab applicator to the coated substrates formed in Table 1, Examples 1 to 4.

TABLE 1

| Coating | Example 1 | Example 2 | Example 3 | Example 4 |
|---|---|---|---|---|
| Dye (%) | 5.00 | 5.00 | 5.00 | 5.00 |
| Calcium Carbonate (%) | 75.00 | 10.00 | 20.00 | 40.00 |
| Clay (%) | — | 55.00 | 65.00 | 25.00 |
| Styrene Butadiene (%) | 20.00 | 30.00 | 0.00 | 20.00 |

TABLE 1-continued

| | | | | |
|---|---|---|---|---|
| Styrene Acrylate (%) | — | 0.00 | 10.00 | 0.00 |
| Starch (%) | — | — | — | 10.00 |

(Percent based on weight)

| Coating | Example 5 | Example 6 | Example 7 |
|---|---|---|---|
| Dye (%) | 5 | 5 | 5 |
| Calcium carbonate (%) | 65 | 0 | 0 |
| Styrene butadiene (%) | 30 | 30 | 0 |
| Clay (%) | 0 | 65 | 65 |
| Styrene acrylate (%) | 0 | 0 | 30 |
| Coating pH | 8.58 | 7.78 | 7.57 |

| Coating | Example 8 | Example 9 | Example 10 | Example 11 |
|---|---|---|---|---|
| Dye slurry (%) | 5 | 5 | 5 | 5 |
| Calcium carbonate (%) | 75 | 65 | 0 | 0 |
| Styrene butadiene (%) | 20 | 30 | 20 | 30 |
| Clay (%) | 0 | 0 | 75 | 65 |
| Coating pH | 8.45 | 8.49 | 7.83 | 7.78 |

With examples 8 and 9 dilute hydrochloric acid was used to achieve reversible imaging. Similarly, oxalic acid at a concentration of 3% or less exhibited rapid reversibility. As the acidic character or concentration of the various commercially available clays or pigments such as silica increases, in Examples 10 and 11 lower concentrations of acidic developer would be selected to achieve rapid reversibility.

For examples 5, 6, and 7 surface pH's of the dried coating were measured prior to acid activation. pH of the wet coatings was adjusted with HCl or NaOH to the indicated values in Table 2. The resultant dried surface pH's are shown.

TABLE 2

| | Adjusted Wet Coating pH | Dried Surface pH |
|---|---|---|
| Example 5 | 5.7 | 7.5 |
| | 8.58 | 7.9 |
| | 11.5 | 8.2 |
| Example 6 | 4.6 | 7.1 |
| | 8.6 | 7.6 |
| | 12.5 | 8.6 |
| Example 7 | 4.5 | 7.4 |
| | 6.5 | 7.3 |
| | 7.5 | 7.6 |
| | 8.5 | 7.9 |
| | 10.16 | 8.6 |

Optimum substrate pH was in the range of 7.5 to 8.0.

TABLE 3

| | Molecular formula | Vapor pressure (kPa) | Molecular Weight | pKa | Reversibility |
|---|---|---|---|---|---|
| Material | | | | | |
| Formic acid | $CH_2O_2$ | 5.68 [25° C.] | 46 | 3.75 | Reversible |
| Acetic acid | $C_2H_4O_2$ | 2.093 [25° C.] | 60 | 4.76 | Reversible |
| Propionic acid | $C_3H_6O_2$ | 0.39 [20° C.] | 74 | 4.87 | Reversible |
| Butyric acid | $C_4H_8O_2$ | 0.0102 [25° C.] | 88 | 4.83 | Reversible |
| Isobutyric acid | $C_4H_8O_2$ | 0.2 [20° C.] | 88 | 4.84 | Reversible |
| Hexanoic acid | $C_6H_{12}O_2$ | 0.027 [20° C.] | 116 | 4.85 | Not reversible |
| Heptanoic acid | $C_7H_{14}O_2$ | 0.1333 [78° C.] | 130 | 4.48 | Not reversible |
| Oxalic acid | $C_2H_2O_4$ | .00004 kPa | 95.07 | 1.19 | Reversible |
| Octanoic acid | $C_8H_{16}O_2$ | | 144 | 4.89 | Not reversible |
| Glycine | $C_2H_5NO_2$ | Not Applicable (Solid) | 75 | 2.34 | No color |
| Alanine | $C_2H_7NO_2$ | Not Applicable (Solid) | 89.09 | 2.33 | No color |
| DL-2-aminobutyric acid | $C_4H_9NO_2$ | | 103.12 | 2.30 | No color |
| Valine | $C_5H_{11}NO_2$ | | 117.15 | 2.27 | No color |
| Leucine | $C_6H_{13}NO_2$ | | 131.17 | 2.32 | No color |
| Glycolic acid | $C_2H_4O_3$ | 2.34 | 76.05 | 3.83 | Not reversible |
| Lactic acid | $C_3H_6O_3$ | <.001 | 90.08 | 3.86 | Not reversible |
| 3-hydroxybutyric acid | $C_4H_8O_3$ | | 104.1 | | Not reversible |
| Malonic acid | $C_3H_4O_4$ | | 104 | 2.85 | Not reversible |
| Material or substance name | | | | | |
| Succinic acid | $C_4H_6O_4$ | | 118 | 4.19 | Not reversible |
| Glutaric acid | $C_5H_8O_4$ | | 132 | 4.32 | Not reversible |
| Adipic acid | $C_6H_{10}O_4$ | | 146 | | Not reversible |
| Benzoic Acid | $C_6H_5COOH$ | | 121 | | Not reversible |
| Dinonyl naphthalene Sulfonic acid | $C_{28}H_{44}O_3S$ | | 460.7 | | Not reversible |
| Dinonyl naphthalene disulfonic acid | $C_{28}H_{45}O_6S_2$ | | 541.7 | | Not reversible |

TABLE 3-continued

| | Molecular formula | Vapor pressure (kPa) | Molecular Weight | pKa | Reversibility |
|---|---|---|---|---|---|
| Pimelic Acid | | | | | Not reversible |
| Salicyclic acid | $C_7H_6O_3$ | | 138.12 | 2.98 | Not reversible |
| Citric acid | $C_6H_8O_7$ | | 192.12 | 3.13 | Not reversible |
| Ascorbic acid | $C_6H_8O_6$ | | 176.12 | 4.10 | Not reversible |
| Benzoic acid | $C_7H_6O_2$ | | 122.12 | 4.20 | Not reversible |
| Phosphorous acid | $H_3PO_3$ | | 83 | | Reversible |

In Table 3, dilute solutions of mineral acid solutions were tested.

| Material or substance name | Molecular formula | Vapor pressure (kPa) | Molecular Weight | pKa | pH | Reversibility |
|---|---|---|---|---|---|---|
| Hydrochloric acid | HCl | 25.34 | 36.45 | Negative | 2.2 | Reversible |
| Phosphoric acid | $H_3PO_4$ | | 98 | 2.12 | | Not reversible |
| Phosphorous acid | $H_3PO_3$ | | 83 | | 2.2 | Reversible |
| Sulfuric acid | $H_2SO_4$ | | 98 | | 2.2 | Reversible |

TABLE 4

| Acidic Developer Formula | Molecular Weight | pH | Tested on paper coated with 5% chromogen (by weight) and binder |
|---|---|---|---|
| Hydrochloric acid HCL | 36.5 | | |
| 40% solution in water | | −9 | Not Reversible |
| 30% solution in water | | −0.78 | Not Reversible |
| 20% solution in water | | −5.4 | Reversible |
| 15% solution in water | | −0.11 | Reversible |
| 10% solution in water | | −0.07 | Reversible |
| 5% solution in water | | −0.29 | Reversible |
| 4.5% solution in water | | −0.19 | Reversible |
| 4% solution in water | | 0 | Reversible |
| 3.5% solution in water | | −0.03 | Reversible |
| 2.5% solution in water | | −0.18 | Reversible |
| 2% solution in water | | 0.09 | Reversible (light color) |
| 1.5% solution in water | | 0.26 | Reversible (light color) |
| 1% solution in water | | 0.39 | Reversible (light color) |
| 0.5% solution in water | | 0.64 | Reversible (light color) |
| Oxalic acid $C_2H_2O_4$ | 95.07 | | |
| 20% solution in isopropanol/water | | 0.82 | Not Reversible |
| 15.0% solution in isopropanol/water | | 0.88 | Not Reversible |
| 10.0% solution in isopropanol/water | | 0.95 | Not Reversible |
| 8.0% solution in isopropanol/water | | 1.03 | Not Reversible |
| 7.0% solution in isopropanol/water | | 1.07 | Not Reversible |
| 6.0% solution in isopropanol/water | | 1.11 | Not Reversible |
| 5.0% solution in isopropanol/water | | 1 | Not Reversible |
| 4.95% solution in isopropanol/water | | | Not Reversible |
| 4.5% solution in isopropanol/water | | 1.35 | Not Reversible |
| 4.0% solution in isopropanol/water | | 1.24 | Not Reversible |
| 3.5% solution in isopropanol/water | | 1.25 | Not Reversible |
| 3% solution in isopropanol/water | | 1.36 | Reversible in 90 secs or less |
| 2.5% solution in isopropanol/water | | 1.45 | Reversible in < 10 secs |
| 2.3% solution in isopropanol/water | | | Reversible |

TABLE 4-continued

| Acidic Developer Formula | Molecular Weight | pH | Tested on paper coated with 5% chromogen (by weight) and binder |
|---|---|---|---|
| 2.0% solution in isopropanol/water | | 1.38 | Reversible |
| 1.5% solution in isopropanol/water | | 1.46 | Reversible |
| 1% solution in isopropanol/water | | 1.66 | Reversible |
| 0.5% solution in isopropanol/water | | 1.77 | Reversible |
| Citric acid $C_6H_8O_7$ | 192.12 | | |
| 50% solution in water | | 0.81 | Not Reversible |
| 34.7% solution in water | | 1.3 | Not Reversible |
| 10% solution in water | | 0.63 | Not Reversible |
| 7% solution in water | | 1.73 | Not Reversible |
| 4.4% solution in water | | 1.92 | Not Reversible |
| Ascorbic acid | | | |
| 10% solution in isopropanol/water | | 2.3 | Not Reversible |
| Salicyclic acid $C_7H_6O_3$ | 138.12 | | |
| 10% solution in water | | 1.87 | Not Reversible |
| 5% solution in water | | 1.85 | Not Reversible |
| 2% solution in water | | 2.08 | Not Reversible |
| Sulfuric acid $H_2SO_4$ | 98 | | |
| 5.8% solution in water | | 2.45 | Reversible |
| 11.4% solution in water | | 1.77 | Not Reversible |
| 19.6% solution in water | | | Not Reversible |
| Glycine $C_2H_5NO_2$ | 75 | | |
| 11.8% solution in water | | 6.7 | No color |
| 4.3% solution in water | | 6.44 | No color |
| DL-Alanine $C_2H_7NO_2$ | 89.09 | | |
| 13% solution in water | | | No color |
| 10.2% solution in water | | 7.17 | No color |
| 12.1% solution in water | | 6.7 | No color |
| DL-2-aminobutyric acid $C_4H_9NO_2$ | 103.12 | | |
| Leucine $C_6H_{13}NO_2$ | 131.17 | | |
| 10.3% solution in water | | 10.32 | No color |
| Dinonylnaphthalene sulfonic acid $C_{28}H_{44}O_3S$ | 460.7 | | |
| 9.7% solution in isopropanol/water | | 1.22 | Not Reversible |
| 4.8% solution in isopropanol/water | | 1.32 | Not Reversible |
| 2.4% solution in isopropanol/water | | 1.53 | Not Reversible |
| 1.2% solution in isopropanol/water | | 1.67 | Not Reversible |
| 0.60% solution in isopropanol/water | | 1.77 | Not Reversible |
| 0.3% solution in isopropanol/water | | 2.01 | Not Reversible |
| 0.2% solution in isopropanol/water | | 2.24 | No Color |
| Dinonylnaphthalene disulfonic acid $C_{28}H_{44}O_6S_2$ | 541.7 | | |
| 27.5% solution in isopropanol/water | | 1.17 | Not Reversible |
| 13.8% solution in isopropanol/water | | 1.09 | Not Reversible |
| 6.9% solution in isopropanol/water | | | Not Reversible |
| 3.4% solution in isopropanol/water | | | Not Reversible |
| 1.7% solution in isopropanol/water | | | Not Reversible |
| 0.8% solution in isopropanol/water | | | Not Reversible |
| 0.4% solution in isopropanol/water | | 1.8 | Faint Color |
| Phosphoric acid $H_3PO_4$ | 98 | | |
| 85% solution in water | | | Not Reversible |
| 60% solution in water | | 0.11 | Not Reversible |
| 37.1% solution in water | | 0.15 | Not Reversible |
| 24.4% solution in water | | 0.39 | Not Reversible |
| 13.44% solution in water | | 0.69 | Not Reversible |

TABLE 4-continued

| Acidic Developer Formula | Molecular Weight | pH | Tested on paper coated with 5% chromogen (by weight) and binder |
|---|---|---|---|
| 7.5% solution in water | | 0.73 | Not Reversible |
| Phosphorous acid $H_3PO_3$ | 83 | | |
| 19% solution in water | | 0.41 | Not Reversible |
| 9.6% solution in water | | 0.57 | Reversible |
| 5% solution in water | | 0.66 | Reversible |
| Boric acid | | | |
| 17.5% solution in water/isopropanol | | | |
| 5.3% solution in water | | | No color |
| 5.3% solution in isopropanol | | | No color |
| Benzoic acid | | | |
| 13.2% solution in isopropanol/water | | 2.45 | Not Reversible |
| Glycolic acid $C_2H_4O_3$ | 76.05 | | |
| 28.4% solution in water | | 1.93 | Not Reversible |
| 14.2% solution in water | | 2.13 | Not Reversible |
| Lactic acid $C_3H_6O_3$ | 90.08 | | |
| Neat | | | Not Reversible |
| 36.8% solution in water | | 2.04 | Not Reversible |
| 20.5% solution in water | | 2.17 | Not Reversible |
| 3-hydroxybutyric acid $C_4H_8O_3$ | 104.1 | | |
| 14.9% solution in water | | 2.65 | Not Reversible |
| Malonic acid $C_3H_4O_4$ | 104 | | |
| 35.8% solution in water | | 0.74 | Not Reversible |
| 20.4% solution in water | | 1 | Not Reversible |
| 13.3% solution in water | | 1.12 | Not Reversible |
| 8.0% solution in water | | 1.26 | Not Reversible |
| Succinic acid $C_4H_6O_4$ | 118 | | |
| 7% solution in isopropanol/water | | 2.21 | Not Reversible |
| Glutaric acid $C_5H_8O_4$ | 132 | | |
| 31.6% solution in water | | 1.77 | Not Reversible |
| 19.7% solution in water | | 2.13 | Not Reversible |
| 11% solution in water | | 3.01 | Not Reversible |
| 5.5% solution in water | | 2.18 | Not Reversible |
| 2.8% solution in water | | 4 | Not Reversible |
| 1.1% solution in water | | 4.38 | Not Reversible |
| Adipic acid $C_6H_{10}O_4$ | 146 | | |
| 10.84% solution in isopropanol/water | | | Not Reversible |
| 5.4% solution in isopropanol/water | | 2.42 | Not Reversible |
| Pimelic acid | | | |
| 26.24% solution in water | | 2.43 | Not Reversible |
| 8.64% solution in water | | 3.28 | Not Reversible |
| 5.1% solution in water | | 3.7 | Not Reversible |
| 2% solution in water | | 4.25 | Not Reversible |
| Formic acid $CH_2O_2$ | 46 | | |
| 88% solution in water | | 0.15 | Reversible in 90 secs |
| 56.4% solution in water | | | |
| 36.1% solution in water | | 0.78 | |
| 25% solution in water | | 1.28 | Reversible in 90 secs |
| 17% solution in water | | 1.72 | Reversible in 90 secs or less |
| 12% solution in water | | 1.72 | |
| 8.1% solution in water | | 1.82 | Reversible in 90 secs or less |
| 5% solution in water | | 2.15 | Very little or no color |
| 4.9% solution in water | | 2.15 | No color |
| 4.5% solution in water | | 2.15 | No color |
| 4.0% solution in water | | 2.13 | No color |
| 3.5% solution in water | | 2.15 | No color |
| 3.0% solution in water | | 2.31 | No color |
| 2.5% solution in water | | 2.35 | No color |
| 2.0% solution in water | | 2.58 | No color |
| 1.5% solution in water | | 2.58 | No color |
| 1.0% solution in water | | 2.83 | No color |
| 0.5% solution in water | | 3.17 | No color |
| Acetic acid $C_2H_4O_2$ | 60 | | |
| 99.7% solution in water | | | Reversible |
| 30% solution in water | | 1.78 | Reversible light color |
| 25% solution in water | | 2.04 | Reversible light color |
| 20% solution in water | | 2 | Reversible light color |

TABLE 4-continued

| Acidic Developer Formula | Molecular Weight | pH | Tested on paper coated with 5% chromogen (by weight) and binder |
|---|---|---|---|
| White vinegar | | 2.69 | Reversible |
| Propionic acid $C_3H_6O_2$ | 74 | | |
| 99.0% solution in water | | | |
| 57.5% solution in water | | 1.86 | Not reversible |
| 44.1% solution in water | | 2.38 | Not reversible |
| 44.9 solution in water | | 2.46 | Not reversible |
| 24.5% solution in water | | 2.6 | Not reversible |
| 14.2% solution in water | | 2.83 | Reversible |
| Butyric acid $C_4H_8O_2$ | 88 | | |
| 29.3% solution in water | | 2.51 | Not reversible |
| 28.5% solution in water | | 2.5 | Not reversible |
| 16.4% solution in water | | | Reversible |
| 7.94% solution in water | | 2.73 | Reversible |
| 14% solution in water | | 2.75 | Reversible |
| Pentanoic acid $C_5H_{10}O_2$ | 102 | | |
| 55.7% w/w solution in isopropanol | | 2.25 | Reversible in 90 seconds or less |
| 32.5% w/w solution in isopropanol | | 3.08 | Reversible in 90 seconds or less |
| 21.4% w/w solution in isopropanol | | 3.3 | Reversible in 90 seconds or less |
| Hexanoic acid $C_6H_{12}O_2$ | 116 | | |
| 60.5% w/w solution in isopropanol | | 3.01 | Not reversible |
| 33.6% w/w solution in isopropanol | | 3.39 | Not reversible |
| 10.6% w/w solution in isopropanol | | 4.29 | Not reversible |
| Heptanoic acid $C_7H_{14}O_2$ | 130 | | |
| 45% solution in isopropanol | | 3.45 | Not reversible |
| 49.3% solution in water | | 3.77 | Not reversible |
| 25.1% solution in isopropanol/water | | 3.73 | Not reversible |
| 9.5% solution in isopropanol/water | | 3.93 | Not reversible |
| 2.6% solution in isopropanol/water | | 4.35 | Not reversible |
| Octanoic acid $C_8H_{16}O_2$ | 144 | | |
| 61.7% solution in isopropanol | | 2.29 | Not reversible |
| 35.4% solution in isopropanol | | 3.02 | Not reversible |
| 13% solution in isopropanol | | 4.23 | Not reversible |
| Nonanoic acid $C_9H_{18}O_2$ | 160 | | |
| 96.0% solution in water | | 3.91 | Not reversible |
| 48.9% solution in water | | 3.97 | Not reversible |
| 25.2% solution in water | | 4.07 | Not reversible |
| 12.6% solution in water | | 4.33 | Not reversible |
| 6.5% solution in water | | 4.8 | Not reversible |
| 1.8% solution in water | | | Not reversible |

Table 4 illustrates various developers used at different concentrations. With certain developers such as oxalic acid, concentration by weight of less than 3% surprisingly yielded rapid reversibility. Above this concentration, coloration was not reversible.

All patents and publications cited herein are hereby fully incorporated by reference in their entirety. The citation of any publication is for its disclosure prior to the filing date and should not be construed as an admission that such publication is prior art or that the present invention is not entitled to antedate such publication by virtue of prior invention.

The principles, preferred embodiments, and modes of operation of the present invention have been described in the foregoing specification. The invention which is intended to be protected herein, however, is not to be construed as limited to the particular forms disclosed, since those are to be regarded as illustrative rather than restrictive. Variations and changes can be made by those skilled in the art without departing from the spirit and scope of the invention.

What is claimed is:

1. A rapidly reversing authenticity indicator for a substrate comprising:

a substrate having provided thereon a coating of a substantially colorless phthalide, leucauramine, or flouran chromogenic material and binder material, an applicator containing a developer material, the developer material comprising an organic acid of five carbons or less, a molecular weight of less than about 102, and a pH of less than 3.5 with the proviso that the organic acid is not acetic acid or formic acid wherein the coated substrate when contacted with the developer material develops an intense color that fades in 90 seconds or less to provide a visual indication of authenticity of the substrate.

2. The authenticity indicator according to claim 1 wherein the substrate is selected from paper or plastic film.

3. The authenticity indicator according to claim 1 wherein the coating on the substrate includes a pigment and has a dried surface pH of from 7.5 to 8.0.

4. The authenticity indicator according to claim 1 wherein the developer material is a liquid acidic material.

5. The authenticity indicator according to claim 1 wherein the developer material solution is an acidic material and solvent.

6. The authenticity indicator according to claim 1 wherein the developer material is selected from propionic acid, butyric acid, isobutyric acid and pentanoic acid.

7. The authenticity indicator according to claim 1 wherein the developer material is a solvent solution of oxalic acid at a concentration by weight of 3% or less.

8. The authenticity indicator according to claim 1 wherein the substantially colorless chromogenic material is a light pale color.

9. The authenticity indicator according to claim 8 wherein the substrate coating includes a pigment of color similar to the chromogenic material.

10. A rapidly reversing authenticity indicator for a substrate comprising:

a substrate having provided thereon a coating comprising a substantially colorless phthalide, leucauramine or flouran chromogenic material and a binder material;

an applicator containing a developer material, the developer material comprising an organic acid of five carbons or less, a molecular weight of less than about 102, a pH of less than 3.5, and a positive vapor pressure with the proviso that the organic acid is not acetic acid or formic acid;

wherein the coated substrate when contacted with the developer material develops an intense color that persists less than about three minutes to provide a visual indication of authenticity of the substrate.

11. The indicator according to claim 10 wherein the developer material is selected from [formic acid, acetic acid,] propionic acid, butyric acid and isobutyric acid.

12. The indicator according to claim 10 wherein the substrate is selected from paper or film.

13. The indicator according to claim 10 wherein the coating on the substrate includes a pigment and has a dried surface pH of from 7.5 to 8.0.

14. A rapidly reversing authenticity indicator for a substrate comprising:

a substrate having provided thereon a coating comprising a substantially colorless phthalide, leucauramine or flouran chromogenic material and a binder material;

an applicator containing a developer material, the developer material comprising an organic acid of five carbons or less, a molecular weight of less than about 102, a pH of less than 3.5, and a positive vapor pressure; wherein the developer material is pentanoic acid; and wherein the coated substrate when contacted with the developer material develops an intense color that persists less than about three minutes to provide a visual indication of authenticity of the substrate.

15. A rapidly reversing authenticity indicator for a substrate comprising:

a substrate having provided thereon a coating comprising a substantially colorless phthalide, leucauramine, or flouran chromogenic material and a binder material;

an applicator containing a developer material, the developer material comprising an organic acid of five carbons or less, a molecular weight of less than about 102, and a pH of less than 2.2 with the proviso that the organic acid is not acetic acid or formic acid;

wherein the coated substrate when contacted with the developer material develops an intense color that persists less than about three minutes to provide a visual indication of authenticity of the substrate.

16. The indicator according to claim 15 wherein the substrate is selected from paper or film.

17. The indicator according to claim 15 wherein the coating on the substrate includes a pigment.

* * * * *